United States Patent [19]

Korolis

[11] 4,138,948

[45] Feb. 13, 1979

[54] RAILWAY HOPPER CAR SIDE DOOR ACTUATING MECHANISM

[75] Inventor: Louis G. Korolis, Dolton, Ill.

[73] Assignee: Pullman Incorporated, Chicago, Ill.

[21] Appl. No.: 791,348

[22] Filed: Apr. 27, 1977

[51] Int. Cl.[2] ..... B61D 7/08; B61D 7/18; B61D 7/26; B61D 49/00

[52] U.S. Cl. ..... 105/251; 105/252; 105/255; 105/256; 105/308 P

[58] Field of Search ..... 49/281; 105/240, 245, 105/248, 251, 255, 289, 295, 310, 252, 256, 308 P

[56] References Cited

U.S. PATENT DOCUMENTS

| | | | |
|---|---|---|---|
| 564,805 | 7/1896 | Stoney et al. | 105/255 |
| 676,104 | 6/1901 | Souder | 105/251 X |
| 726,169 | 4/1903 | Kiesel, Jr. | 105/255 |
| 789,155 | 5/1905 | Kiesel, Jr. | 105/255 |
| 1,000,753 | 8/1911 | Olden | 105/240 |
| 1,035,389 | 8/1912 | Seaberg | 105/245 |
| 1,035,439 | 8/1912 | Hilman | 105/255 |
| 1,284,111 | 11/1918 | Kestler | 105/251 |
| 1,375,700 | 4/1921 | Ingoldsby | 105/295 X |
| 3,166,024 | 1/1965 | Hamilton | 105/289 X |
| 3,187,684 | 6/1965 | Ortner | 105/248 |
| 3,188,980 | 6/1965 | Tearpock et al. | 105/240 |
| 3,192,876 | 7/1965 | Ortner | 105/251 X |
| 3,315,616 | 4/1967 | Beaveret al. | 105/240 X |
| 3,408,956 | 11/1968 | Rebenok et al. | 105/240 |
| 3,789,772 | 2/1974 | Bullard | 105/240 |
| 3,816,965 | 6/1974 | Nagy | 49/281 X |
| 3,868,913 | 3/1975 | Becker et al. | 105/240 |
| 3,931,768 | 1/1976 | Price et al. | 105/240 |

*Primary Examiner*—L. J. Paperner
*Assistant Examiner*—Howard Beltran
*Attorney, Agent, or Firm*—Thomas G. Anderson

[57] ABSTRACT

A side dump railway hopper car with outwardly movable discharge doors includes a door operating mechanism including pivoted keeper engaging members adapted to be rotated between lock an open positions. The pivoted keeper engaging members are actuated by linkage mechanism transversely movable by a longitudinally extending movable cam adapted to be supported on the underframe of the hopper car.

11 Claims, 12 Drawing Figures

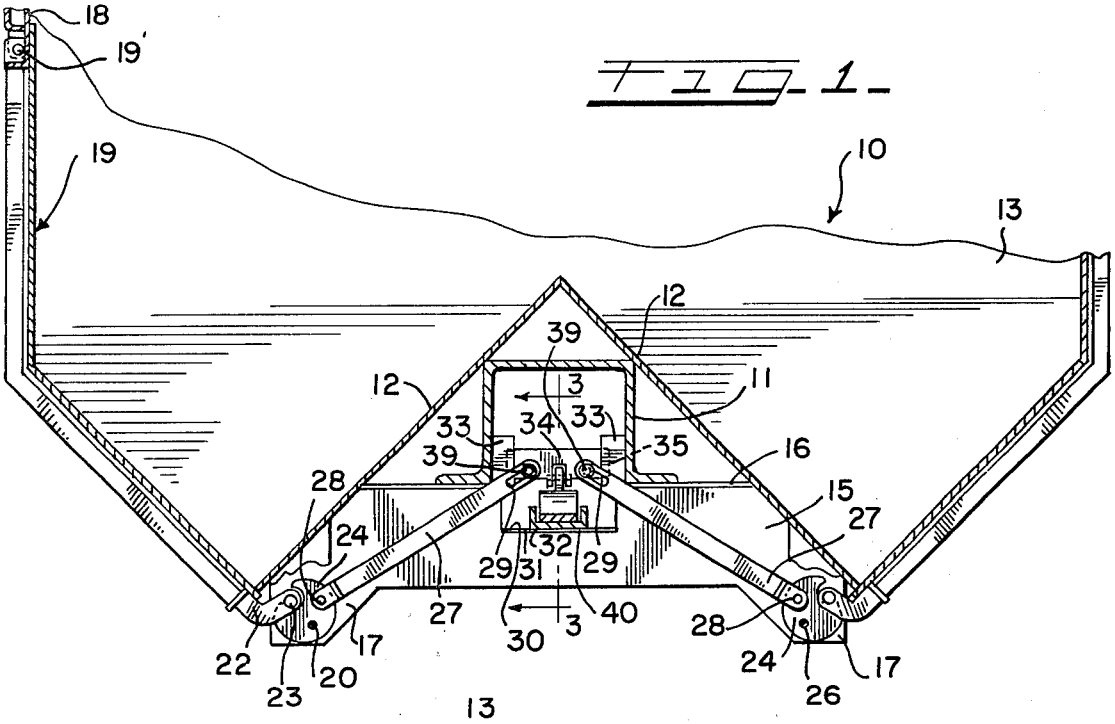
FIG. 1
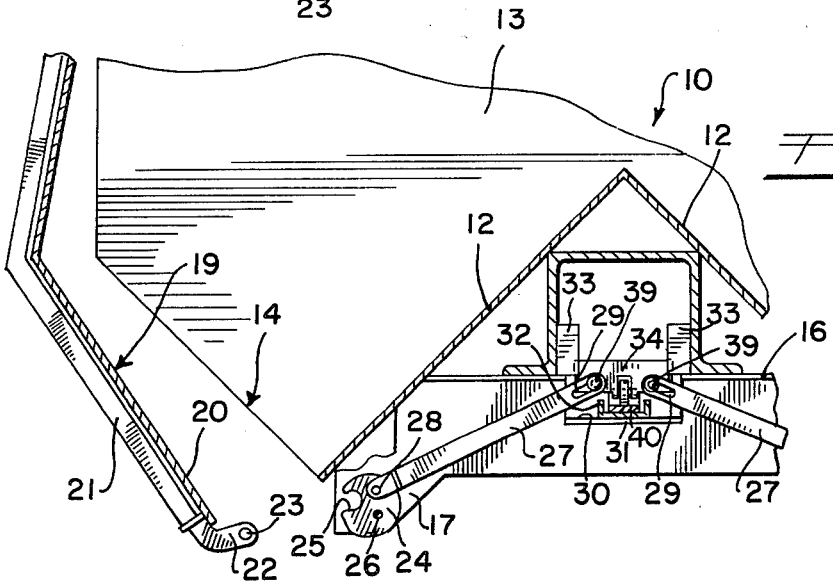
FIG. 2
FIG. 3
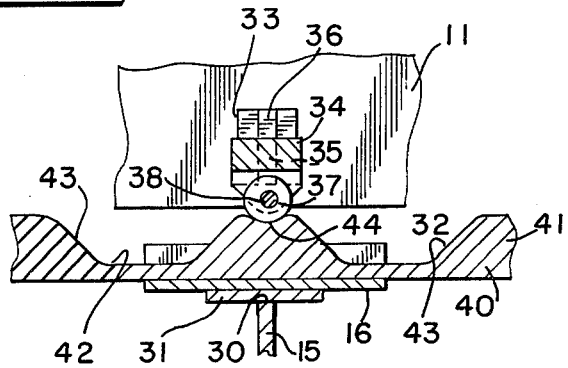
FIG. 4
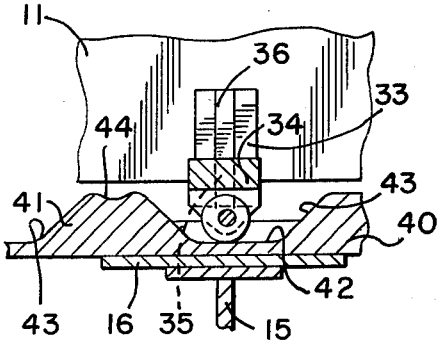

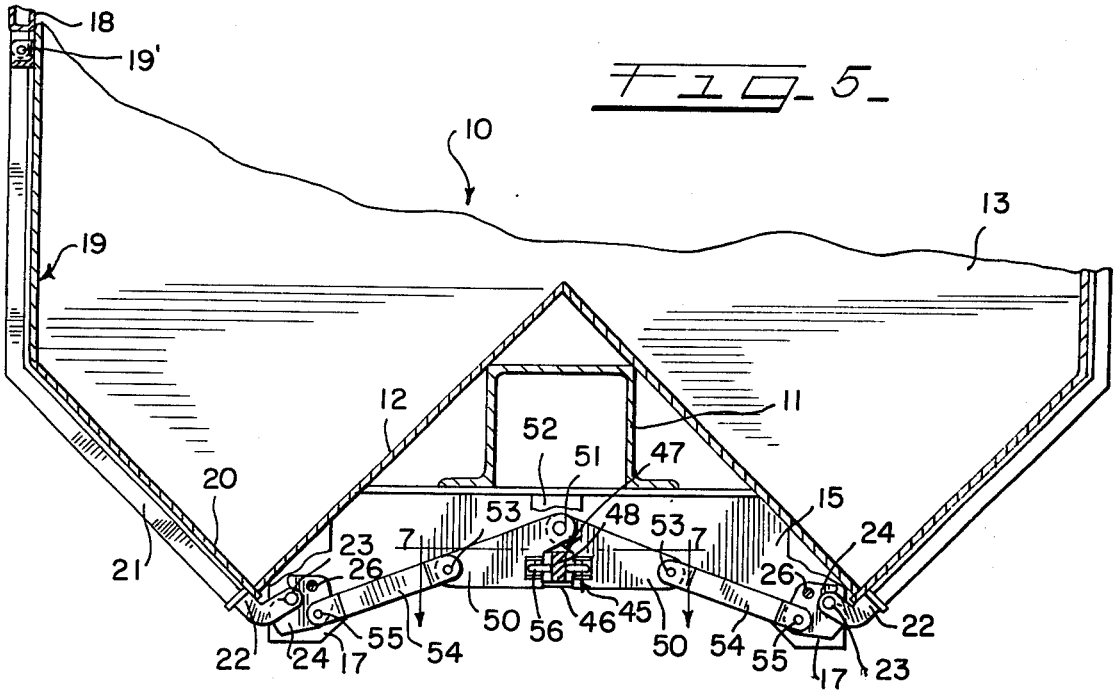
FIG. 5
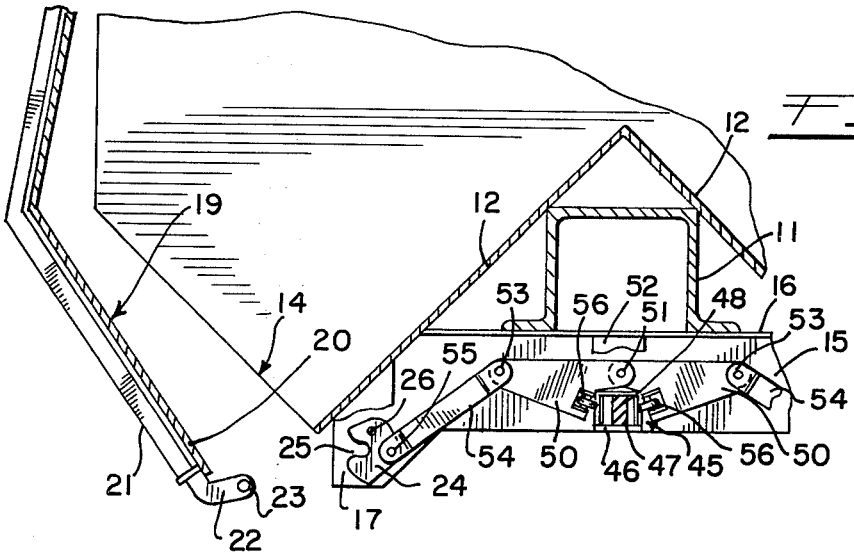
FIG. 6
FIG. 7
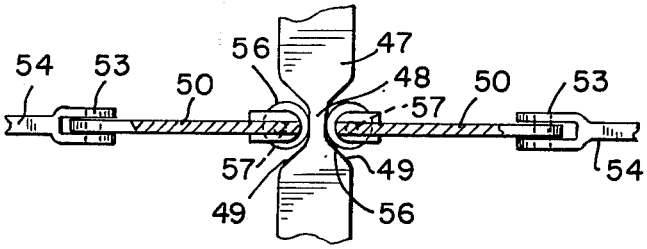
FIG. 8
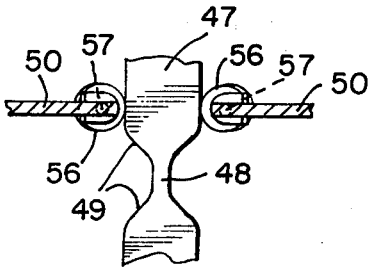

RAILWAY HOPPER CAR SIDE DOOR ACTUATING MECHANISM

BACKGROUND OF THE INVENTION

1. Field of the Invention

The present invention relates to railway hopper cars having side dump discharge openings and doors, and particularly to an actuating mechanism for locking and unlocking said doors.

2. Description of the Prior Art

Pertinent prior art patents concerned with locking and unlocking side discharge doors of hopper cars are U.S. Pat. Nos. 1,284,111 Nov. 5, 1918 which discloses a drop door mechanism having a longitudinally reciprocable operating mechanism, 1,035,389 Aug. 13, 1912 and, 3,192,876 July 6, 1965 which show bottom dump hopper door mechanisms, 3,315,616 Apr. 25, 1967 which shows a motor actuated drop bottom hopper car having longitudinally reciprocable door latch engaging slide bars; and, and 3,408,956 Nov. 5, 1968 which shows a motor actuated door operating mechanism for side dumping hopper cars. The present invention is an improvement over the foregoing patents.

SUMMARY OF THE INVENTION

In the present invention a hoppper car is provided with side discharge doors which are in either lock or unlocked positions. When the doors are unlocked the weight of the material within the car is discharged by gravity as the doors are forced outwardly by virtue of the downwardly diverging configuration of the slope sheets within the car. After material has been discharged the doors again are moved by gravity or other force to a closed position. A door actuating or locking mechanism includes a rotatable keeper engaging member which is mounted on the outer frame of the car and which in the closed position engages a keeper pin provided on a keeper member connected to the lower end of the door. Door actuating means includes a mechanism which rotates the keeper engaging members to a position releasing the doors so that the materials may be dumped. The mechanism further includes linkage means which is movable transversely of the cars inwardly and outwardly thereby rotating the keeper engaging rotatable members. The linkage mechanism is transversely movable by means of a longitudinally movable cam having cam engaging surfaces with said longitudinally movable cams slideable along the center line of the car on suitable supports forming part of the underframe of the car. A preferred embodiment includes a vertically movable slide which is actuated in response to the longitudinal movement of the longitudinal cam member which engages cam rollers suitably mounted on said slide member. Modifications of the invention includes pivoted arms which also are pivoted by a longitudinal cam member which in turn provide for inward and outward movement of the transverse links connected to the rotatable keeper engaging members. Another modification includes second links connected to the first linkage arrangement with the second links also being transversely movable in response to longitudinal movement of a longitudinally movable cam supported on the underframe of the car.

BRIEF DESCRIPTION OF THE INVENTION

FIG. 1 is a cross-sectional view through the lower discharge portion of a conventional side dump hopper car;

FIG. 2 is a view similar to FIG. 1 showing a side discharge door released to an open position;

FIG. 3 is a cross-sectional view taken substantially along the line 3—3 of FIG. 1 showing a longitudinal cam and associated parts in one position;

FIG. 4 is a view similar to FIG. 3 showing another position of the cam and associated parts;

FIG. 5 is a cross-sectional view similar to FIG. 1 showing a modified form of the invention;

FIG. 6 is a cross-sectional view similar to FIG. 5 showing an unlocked position of a side discharge door;

FIG. 7 is a cross-sectional view taken substantially along the line 7—7 of FIG. 5;

FIG. 8 is a cross-sectional view similar to FIG. 7 showing another position of the arrangement disclosed;

DESCRIPTION OF THE PREFERRED EMBODIMENT

Figure 9:
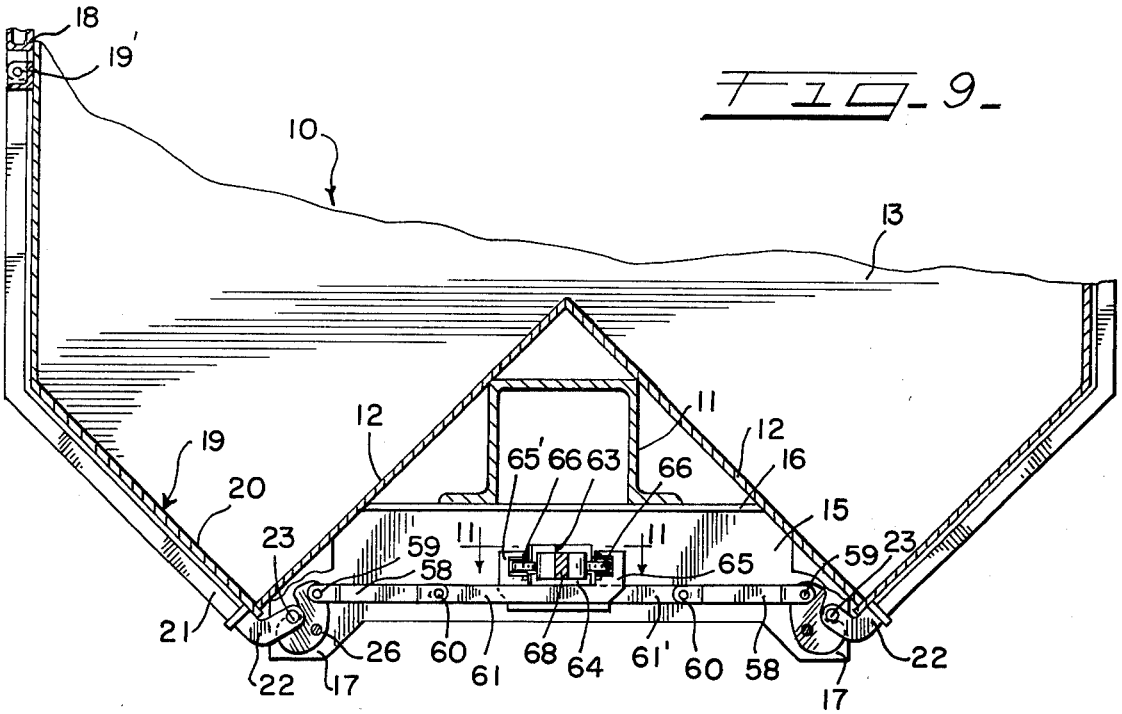
FIG. 9 is a cross-sectional view of a hopper car similar to FIGS. 1 and 5 showing another modified form of the invention of a door operating mechanism.
Figure 10:
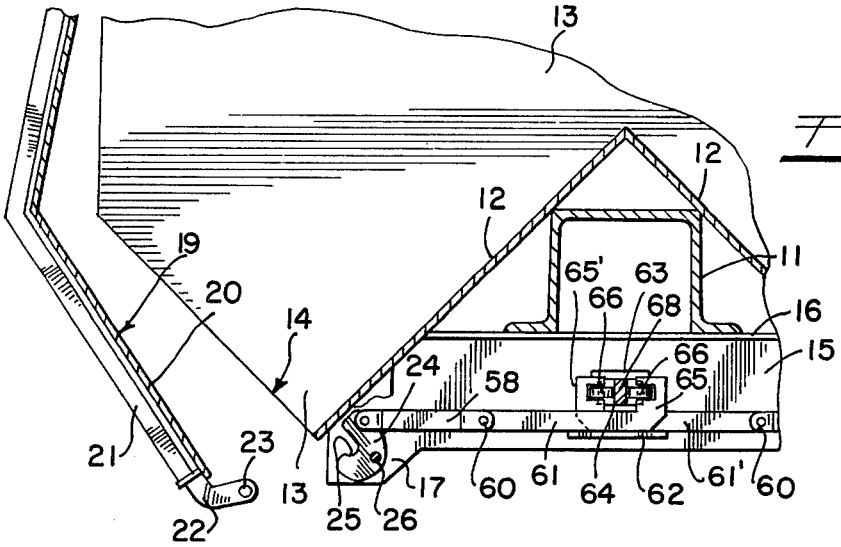
FIG. 10 is a cross-sectional view similar to FIG. 9 showing an unlocked position of a discharge door.
Figure 12:
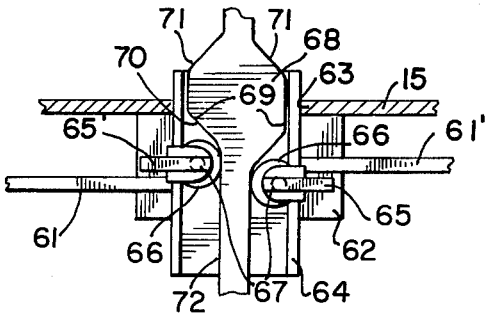
FIG. 12 is a view similar to FIG. 11 showing another position of the associated parts and arrangement.

Referring particularly to FIGS. 1, 5 and 9 a railway hopper car is generally designated by the reference character 10 which includes a center sill and underframe construction 11 supporting downwardly and outwardly diverging slope sheets 12. The slope sheets 12 support a plurality of longitudinally spaced divider walls 13 which form hoppers of conventional construction for supporting materials carried by the hopper car. Each of the hoppers formed by the divider walls 13 includes an outer discharge opening 14 which permits material to be discharged sideways outwardly of the hopper car into suitable discharge bins provided adjacent the railway track. The underframe and center sill construction 11 supports a plurality of longitudinally spaced and transversely extending supports 15 which are provided at their upper ends with horizontal flat flanges 16. On opposite sides of the supports 15 there are provided lower outwardly projecting plates 17. The railway hopper car 10 also includes vertical hopper sidewalls 18 to which doors 19 are hingedly connected. Each of the doors 19 of the car includes door sheets 20 suitably provided with outer reinforcing angles 21. The doors 19 are pivoted for inward and outward movement by suitable hinge construction 19' connected to the lower ends of the vertical side walls 18. Each of the doors is provided at its lower end with a keeper hook 22 having a longitudinally extending keeper bar portion 23. The keeper bars 23 of each of the doors is adapted to be engaged by a rotatable keeper engaging member or disc 24 provided with engageable slots 25 within which the keeper bars 23 are seated in a closed position of the doors. Each of the keeper engaging members or discs 24 is pivoted as indicated at 26 to the lower outwardly projecting plate 17 of the support 15. The aforementioned structure is common to the preferred embodiment shown in FIGS. 1–4 as well as to the modifications shown in FIGS. 5–9.

FIGS. 1–4 disclose the structure wherein an actuating link 27 is pivotally connected as indicated at 28 to each of the rotatable keeper engaging members 24. The innermost end of the actuating link 27 is provided with a slot 29. The transversely extending support 15 is also provided with a cut-out 30 and a horizontal plate 31 is supported on the transversely 15 extending support within the cut-out 30. The plate 31 supports a longitudinally extending U-shaped guide or channel 32. A pair of laterally spaced guide blocks 33 are firmly secured to the sidewally of the center sill 11 and support for vertical movement thereon the vertical slide member 34. As best shown in FIG. 1, 3 and 4 slide projections 35 of the vertically movable slide member 34 slide within vertical slots 36 provided in guide blocks 33 as best shown in FIGS. 3 and 4. The vertically movable slide members 34 are provided at their lower ends with rollers or wheels 37 which are pivoted on shaft 38 secured within recesses provided in the vertically movable slide members 34. Pivot pins 39 extend longitudinally outwardly from slide members 35 and are connected for limited sliding movement within the slots 29 of the actuating links 27.

A horizontal and longitudinally movable cam bar 40 is supported in the U-shaped guide 32. The hopper cars of the prior art are usually provided with 3 or 4 longitudinally spaced hoppers with suitable side door openings for discharging materials. The present cam bar will extend the length of the car so as to be able to actuate each of the doors for locking and unlocking them. In the prior art longitudinally movable members have been actuated by levers supported on the ends of the car which in turn are manually operated. Other designs of the prior art disclose such longitudinal actuating members as being moved hydraulically or pneumatically. The longitudinally extending cam bar 40 thus is supported for sliding movement as shown by one of a plurality of the U-shaped guides 32 which are supported from the center sill 11 by means of the transverse bracket 15. The cam bar 40 includes raised cams 41 and intermittent flat cam surfaces 42. The cam bar further includes sloping cam surfaces 43, and at the high point of the cams 41, includes arcuate cam surfaces 44 which may support the rollers 37 in a certain position of the door operating mechanism.

OPERATION OF THE PREFERRED EMBODIMENT

In FIG. 1 the keeper engaging member 24 of each of the doors has a slot 25 engaged by the keeper bars 23 which securely holds the doors in the closed position. At this point the slide member 34 is in its uppermost position and is held there since the rollers 37 are engaged on the arcuate cam surface 44 of the raised cam 41. By virtue of this engagement the doors are securely locked. If it is desired to move the doors to a released or open position the bar 40 is moved longitudinally by any well know means whereupon the rollers 37 are moved downwardly on the inclined cam surfaces 43 to the flat cam surfaces 42. This downward movement has occured as shown in FIG. 2 whereupon the link 27 has now pivoted the keeper engaging rotatable member 24 to a position whereupon the keeper bar 23 may readily move outwardly from the slot 25 of each of the members 24. This release then is occasioned whereupon the weight of the material on the slope sheets 12 forces the door 19 outwardly to the open position whereupon the load may be freely discharged.

After the load has been discharged the doors will assume the position shown in FIG. 1 wherein the keeper 23 is again in the position to be locked and wherein pivot pin 39 is at the bottom of slot 29. The longitudinal bar 40 is now moved which in turn provided for the roller 37 being forced up by the inclined surface 43 which moves the slide member 34 upwardly in the slot 36 to the position shown in FIG. 1 wherein the keeper engaging member 24 is again in locked position relative to the keeper bar 23.

DESCRIPTION OF THE MODIFICATION

In FIG. 5 the transversely extending supports 15 are each provided with cut-outs 45 which in turn have at their lower ends a support for a ledge plate 46. The ledge plate 46 of each of the supports 15 is adapted to support a cam bar 47 having as best shown in FIG. 7 and 8 vertical flat portions 48, and inclined cam faces 49. In this modification each of the doors is actuated by pivotal arm 50, said arms 50 being supported for hinged pivotal movement as indicated at 51 to the supports 15 as well as being pivoted to a vertical bracket 52 which extends downwardly from the upper flange 16 of the support 15.

Only a portion of the bracket 52 has been shown but it is clear that this bracket also supports the pivot pin 51 in turn supporting the arms 50. Each of the arms 50 is also provided with a pivot means 53 attached at the inner end to a link 54 the said link 54 also being pivotally connected as indicated at 55 to each of the keeper engaging rotatable members 24. Each of the arms 50 also is provided with a self aligning roller 56 journalled on shaft 57 disposed within cut-outs in the arms 50.

In the operation of this modification the cam bars 47 again are movable longitudinally by any well known means. FIG. 1 discloses the locked or closed position wherein the rollers 56 are disposed in the vertical flat cam portions 48 of the bars 57. As the cam bar is moved longitudinally the rollers slide outwardly on inclined surfaces 49 which in turn pivots the arms 50 in an upward and outward direction thereby moving the links 54 in a manner wherein the keeper engaging members 24 are moved to the open position shown in FIG. 6 whereupon the keeper bar 23 is released so that the doors are now movable to an open position. FIG. 8 discloses the position of the roller 56 when the keeper engaging members 24 are in the open position shown in FIG. 6. Return movement of the cam bar of course again effectuates closing and locking of the doors after the load has been discharged.

FIGS. 9–12 disclose another modified form of the invention wherein the keeper engaging member or disc is pivotally connected to a link 58 by means of pivot 59. The other end of the link 58 is pivotally connected by means of a pivot 60 to a link 61 with both links extending linearly transversely with respect to the car. The link 61 is adapted to be supported on a slide plate 62 which is connected to the lower end of the transverse support 15 and extends longitudinally outwardly with respect thereto. The transverse support 15 also is provided with a cut-out 63 which supports a longitudinally extending U-shaped or channel-shaped guide 64. The link 61 is provided with a vertically extending plate-like projection 65 supporting a roller 66 by suitable shaft or pivot means 67 within a cut-out provided in the projection 65. As shown in FIG. 9 a similar horizontal link 61' is connected to the other link 58 and is positioned in overlapping relation in longitudinally spaced disposition relative to the other link 61. The link 61' also includes a vertically extending plate projection 65' similar to the projection 65. The plate projection 65' is also provided with a suitable cut-out for supporting therein another roller 66 by means of a pivot shaft 67. It is apparent that the ends of the links 61 and 61' and their associated vertical plate projections 65 and 65' are positioned in overlapping relation on opposite sides of a longitudinal cam bar 68. The cam bar 68 may be moved longitudinally for opening and closing the doors. The cam bar 68 also includes wide cam surfaces 69 with inclined surface portion 70 and 71 merging with flat cam surfaces 72.

Figure 11:
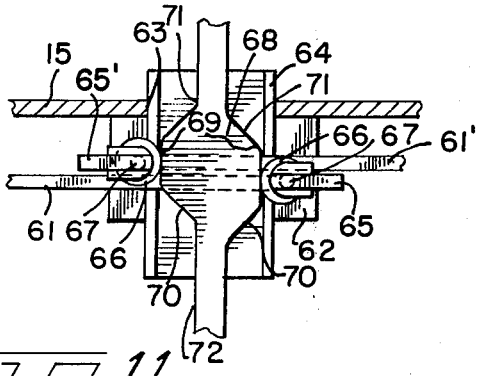
FIG. 11 is a cross-sectional view substantially along the line 11—11 of FIG. 9.

In the foregoing modification, in FIG. 9 the doors are in the closed and locked position. FIG. 11 shows a position of the roller 66 in relation to the cam surfaces 69 wherein the locked position is disclosed. By shifiting the bar 68 longitudinally by any well known means the rollers travel on the surfaces 70 and 71 to the narrow cam portion 72 which provides for movement of the rollers in a direction toward each other. The links 60 and 61' now move outwardly whereupon the keeper engaging members 24 are pivoted to the open position shown in FIG. 10 since the rollers 66 have now assumed the positions shown in FIG. 12. Thus the load is discharged and as the door 19 returns to the closed position the longitudinal cam bar is again moved into the position shown in FIG. 9 locking the door against outward movement.

What is claimed is:

1. A hopper car having a longitudinally extending center sill, slope sheets within said car enclosing said center sill and extending downwardly and outwardly relative to said center sill and providing at their outer ends side discharge openings, doors pivotally mounted at their upper ends on said car for each discharge opening, said doors having lower ends and being movable outwardly from closed to open positions, a keeper member on the lower ends of each of said doors, the improvement of a door locking and unlocking mechanism comprising;

a support means on said car bridging the space between said slope sheets, latch members rotatably mounted on said support means adjacent to the ends of said slope sheets, each of said latch members having keeper members engaging means in one rotated position engaging the respective keeper member in locked position, actuating links each having a crank connection to a respective latch member, a shiftable longitudinally extending cam bar having an undulated surface and being supported on said support means beneath said center sill for longitudinal movement, and cam actuated means connected to said actuating links and engaged by said variable width cam bar during movement thereof to move the links transversely of the car and thus to rotate said latch members between locked and unlocked positions relative to said keeper means upon selective movement of said cam bar.

2. The invention in accordance with claim 1, said cam actuated means comprising a guided slide member supported within said center sill for vertical sliding movement, said slide member including a cam follower supported on said reciprocating cam bar.

3. The invention in accordance with claim 2, wherein said undulated surface includes raised cam surfaces and longitudinally spaced intermittent lowered flat cam surfaces engaged by said cam follower.

4. The invention in accordance with claim 3, said center sill including vertical guide members disposed on opposite sides of said slide member for guiding the same.

5. The invention in accordance with claim 1, said cam actuated means comprising a pair of arms pivotally connected at first ends to said support means for swinging movement about longitudinal axes, means pivotally connecting second ends of said arms to said actuating links, said arms including a cam follower engaging said reciprocating cam bar.

6. The invention in accordance with claim 5, wherein said undulated surface includes a plurality of laterally outwardly projecting cam surfaces, and longitudinally spaced intermittent narrow flat cam surfaces engaged by said cam followers.

7. The invention in accordance with claim 6, said longitudinal cam bar being slidably supported within a recessed guide surface on said support means.

8. The invention in accordance with claim 1, said cam actuated means including second links having first ends pivotally connected to said first links, said first and second links extending substantially horizontally linearly and in parallel rotation to said support means, said second links having second ends disposed in overlapping relation on opposite sides of said cam bar, and cam followers on said second ends engaging opposite sides of said cam bar.

9. The invention in accordance with claim 8, wherein said undulated surface includes a plurality of longitudinally spaced and laterally outwardly projecting cam surfaces, and longitudinally spaced intermittent narrow flat cam surfaces engaged by said cam followers.

10. The invention in accordance with claim 9, said support means including a horizontal slide plate supporting the second ends of said second links for transverse reciprocating movement, said longitudinal cam bar being slidably supported within a recessed guide surface on said support means.

11. A hopper car having a longitudinally extending center sill, slope sheets within the car at opposite sides of said center sill extending downwardly and outwardly relative to said center sill and providing at their outer ends side discharge openings, a door pivotally mounted at its upper ends on said car for each discharge opening, said doors having lower ends movable outwardly from closed to open positions, a keeper on the lower end of each door, the improvement of a door locking and unlocking mechanism, comprising:

support means having a portion mounted within said center sill and having portions extending laterally from said center sill beneath adjacent slope sheets, latch members rotatably mounted on said support means adjacent to the outer ends of respective slope sheets, each latch member having means for engaging in one rotated position the respective keeper in locked position, and operating means for rotating said latch members between open to closed positions having a longitudinally extending cam bar having an undulated surface and being slidably mounted on said support means in alignment with said center sill and cam-operated actuating means extending laterally from opposite sides of the center sill to respective latch members and operatively connected thereto and cam means flanking said bar and in camming engagement therewith and connected with said actuating means and vertically displaceable into said center sill attendant to longitudinal movement of said cam bar.

* * * * *